US008912969B2

(12) United States Patent
Huang

(10) Patent No.: US 8,912,969 B2
(45) Date of Patent: Dec. 16, 2014

(54) DIRECTIONAL ANTENNA AND RADIATING PATTERN ADJUSTMENT METHOD

(75) Inventor: Hsiao-Ting Huang, Hsinchu County (TW)

(73) Assignee: Mediatek Inc., Science-Based Industrial Park, Hsin-Chu (TW)

( * ) Notice: Subject to any disclaimer, the term of this patent is extended or adjusted under 35 U.S.C. 154(b) by 277 days.

(21) Appl. No.: 13/342,987

(22) Filed: Jan. 4, 2012

(65) Prior Publication Data

US 2013/0169502 A1 Jul. 4, 2013

(51) Int. Cl.
*H01Q 19/10* (2006.01)

(52) U.S. Cl.
USPC ..... 343/834; 343/795; 343/815; 343/818

(58) Field of Classification Search
CPC ..... H01Q 19/10
USPC ..... 343/700 MS, 754, 792.5, 795, 815, 833, 343/876, 818, 834
See application file for complete search history.

(56) References Cited

U.S. PATENT DOCUMENTS

| | | | | |
|---|---|---|---|---|
| 5,220,335 | A * | 6/1993 | Huang | 343/700 MS |
| 6,046,703 | A * | 4/2000 | Wang et al. | 343/795 |
| 6,529,171 | B1 * | 3/2003 | Le Balier et al. | 343/795 |
| 6,975,278 | B2 * | 12/2005 | Song et al. | 343/795 |
| 8,228,254 | B2 * | 7/2012 | Foltz et al. | 343/795 |
| 2007/0195004 | A1 * | 8/2007 | Rebeiz et al. | 343/876 |
| 2011/0090131 | A1 * | 4/2011 | Chen et al. | 343/815 |

* cited by examiner

*Primary Examiner* — Tho G Phan
(74) *Attorney, Agent, or Firm* — Winston Hsu; Scott Margo

(57) ABSTRACT

The present invention discloses a directional antenna for a multi-in multi-out or antenna beam switchable wireless communication system, including a substrate, at least one directional antenna, formed on the substrate, for generating a radiating pattern of a radiation plane according to a feeding signal, and a reflector, disposed in parallel to the radiation plane of the directional antenna, for reflecting the radiating pattern of the directional antenna, to increase a gain of the directional antenna corresponding to the radiation plane.

12 Claims, 9 Drawing Sheets

DIRECTIONAL ANTENNA AND RADIATING PATTERN ADJUSTMENT METHOD

BACKGROUND OF THE INVENTION

1. Field of the Invention

The present invention relates to a directional antenna and radiating pattern adjustment method, and more particularly, to a directional antenna and radiating pattern adjustment method increasing antenna gain by adding a reflector.

2. Description of the Prior Art

An electronic product with a wireless communication function, such as a laptop computer, a personal digital assistant (PDA) and soon, transmits or receives radio signals through an antenna to access a wireless network. Therefore, for facilitating the wireless network access, an ideal antenna should have a wide bandwidth and a small size to meet the trends of compact electronic products.

A highly directional antenna such as a Yagi-Uda antenna achieves high gain over a rather narrow band. As a result, multiple Yagi-Uda antennas are commonly utilized in a wireless communication system supporting multi-in multi-out (MIMO) technology or a beam switchable antenna system. With a proper arrangement of the multiple Yagi-Uda antennas, the wireless communication system can reach high data throughput and significantly increase transmission distance under limited bandwidth or power expenditure.

In order to reach better performance of the Yagi-Uda antenna, a conventional method is to add directors to the Yagi-Uda antenna, which can direct a current route in a radiator of the Yagi-Uda antenna. In such a situation, directivity and antenna gain of the Yagi-Uda antenna increase. However, antenna body and the area of the Yagi-Uda antenna also increase.

In order to meet the trends of compact electronic products, there is a need to increase antenna gain and directivity of the Yagi-Uda antenna without increasing antenna area.

SUMMARY OF THE INVENTION

It is therefore an object to provide a directional antenna and radiating pattern adjustment method for a multi-in multi-out or a beam switchable antenna system.

The present invention discloses a directional antenna for a multi-in multi-out or a beam switchable antenna system, including a substrate, at least one directional antenna, formed on the substrate, for generating a radiating pattern of a polarization direction according to a feeding signal, and a reflector, disposed in parallel to the radiation plane of the directional antenna, for reflecting the radiating pattern of the directional antenna, to increase a gain of the directional antenna corresponding to the polarization direction.

The present invention further discloses a radiating pattern adjustment method for a directional antenna, including reflecting a radiating pattern of a signal transmitted from the directional antenna by a reflector in parallel to a radiation plane of the directional antenna, to improve a gain of the directional antenna corresponding to the radiation plane.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
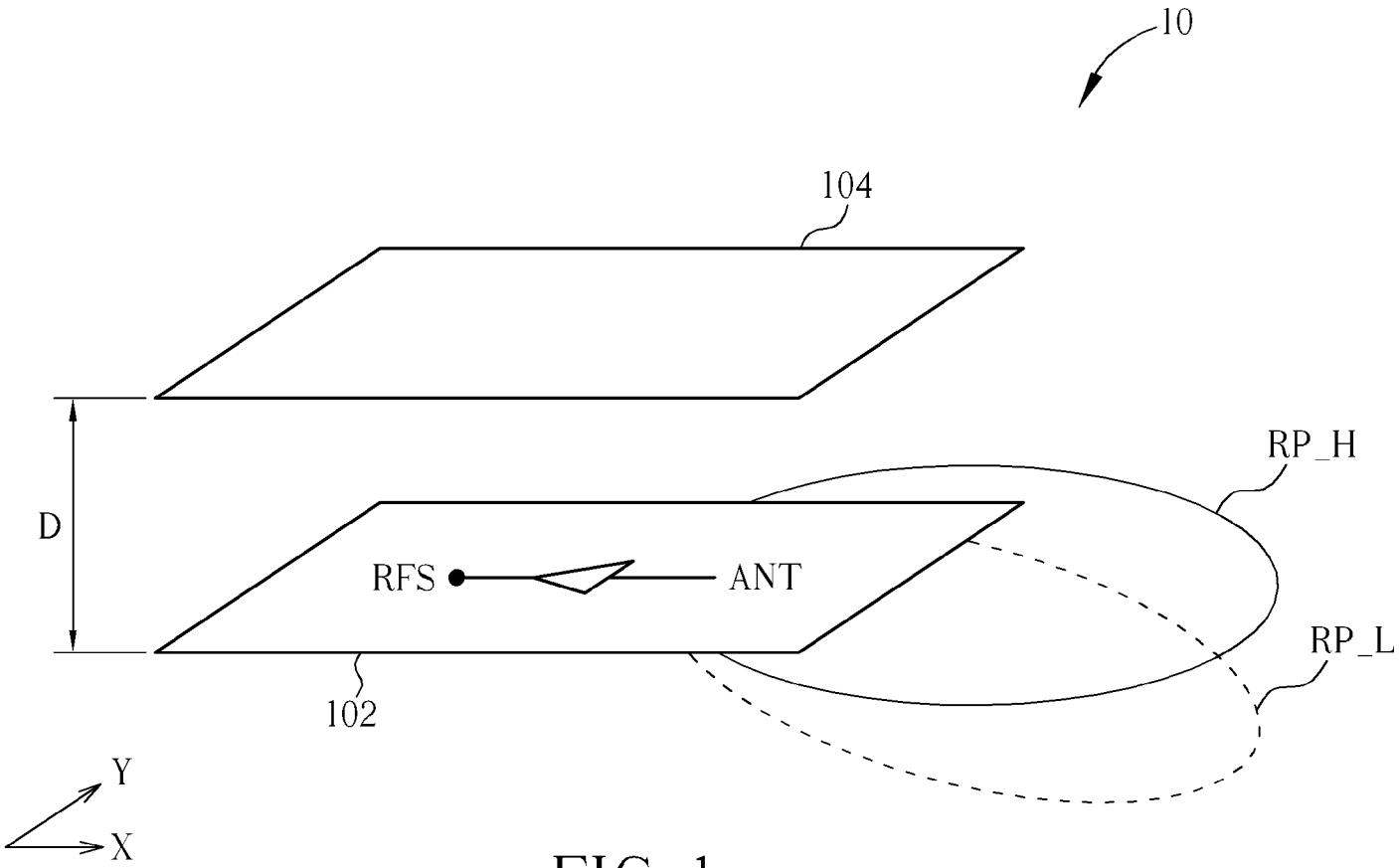
FIG. 1 is a schematic diagram of a directional antenna according to an embodiment of the present invention.
Figure 2A:
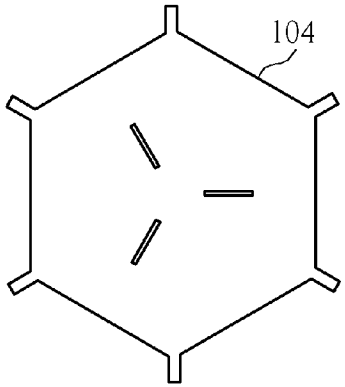
FIG. 2A to FIG. 2D are schematic diagrams illustrating feasible shapes of the reflector in FIG. 1.
Figure 2B:
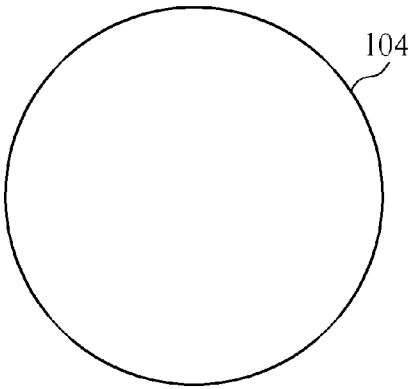
Figure 2C:
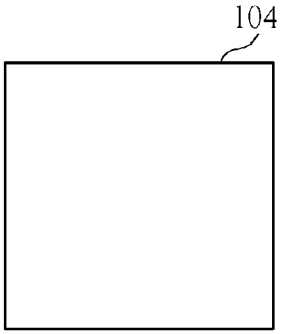
Figure 2D:
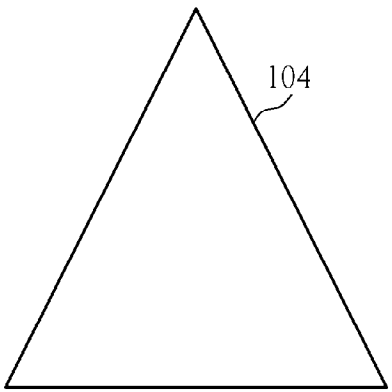

Please refer to FIG. 1, which illustrates a schematic diagram of a directional antenna 10 according to an embodiment of the present invention. The directional antenna 10 is suitable for a wireless communication system supporting MIMO technology, such as IEEE 802.11n system, but not limited to this. The directional antenna 10 includes a substrate 102, a directional antenna ANT, and a reflector 104. The directional antenna ANT is a dual-band horizontally polarized antenna and is arranged on the substrate 102, for generating radiating patterns RP_H and RP_L according to a radio-frequency (RF) signal RFS, and performing RF signal transmission and reception simultaneously. As shown in FIG. 1, the radiating patterns RP_H and RP_L are substantially along a horizontal radiation plane XY. The reflector 104 is disposed in parallel to the radiation plane XY, for reflecting the radiating patterns RP_H and RP_L, so as to increase a gain corresponding to the radiation plane XY of the directional antenna ANT.

In addition, the radiating pattern RP_H of the directional antenna ANT is the maximum gain cutting plane for high operating frequency bands, e.g. 5.45 GHz. The radiating pattern RP_L of the directional antenna ANT is the maximum gain cutting plane for low operating frequency bands, e.g. 2.45 GHz. As can be seen from FIG. 1, the maximum gain cutting plane of the radiating pattern RP_H is substantially within the radiation plane XY, while the maximum gain cutting plane of the radiating pattern RP_L is a sloping downward plane. In such a situation, a distance D between the directional antenna ANT and the reflector 104 is adjustable to change the radiating patterns RP_H and RP_L, so as to meet system requirements, and thus antenna design is more flexible.

More specifically, according to electromagnetic theorem, when a metal sheet is insulated from a radiator with an area which is greater than a half wavelength of an incident radio wave radiated from the radiator, surface electrons of the metal sheet resonant with the incident radio wave, to generate a reflected radio wave with a frequency the same as a frequency of the incident radio wave, and with a reflected angle corresponding to an incident angle of the incident radio wave. In such a situation, the metal sheet appears reflecting the incident radio wave from the incident angle toward the reflected angle. Likewise, when the directional antenna ANT radiates the RF signal RFS to the air, the reflector 104 reflects the radiated RF signal RFS, such that a part of the RF signal RFS is reflected toward the radiation plane XY due to a reflection effect of the reflector 104, and thus a radiating pattern of the directional antenna ANT is changed. As a result, the gain corresponding to the radiation plane XY of the directional antenna ANT is improved.

In other words, the reflector 104 reflects a part of the RF signal RFS radiated from the directional antenna ANT, such that a part of the RF signal RFS is reflected toward the radiation plane XY, which adjusts the radiating patterns RP_H and RP_L, and thus the gain corresponding to the radiation plane XY of the directional antenna ANT is improved.

Please note that, the present invention is to increase the gain corresponding to the radiation plane XY of the directional antenna ANT via disposing the reflector 104 in parallel to the radiation plane XY. Type and number of the directional antenna ANT are not limited; for example, the directional antenna ANT can be any kind of directional antenna, such as a Yagi-Uda antenna, and may dispose or print multiple directional antennas on the substrate 102, as long as the multiple directional antennas have a same polarization direction, e.g. horizontal or vertical polarization direction. Material and shape of the reflector 104 are not limited either. For example, the reflector 104 can be made of iron, copper, or other pure or hybrid metal materials. The shape of the reflector 104 is not limited. For example, please refer to FIGS. 2A-2D, which are schematic diagrams illustrating feasible shapes of the reflector 104, i.e. a hexagon, a circle, a square and a triangle. Certainly, other geometric figures or irregular shapes may suitable for the reflector 104. Those skilled in the art should make modifications or alterations, and not limited to the above description and examples.

Figure 3:
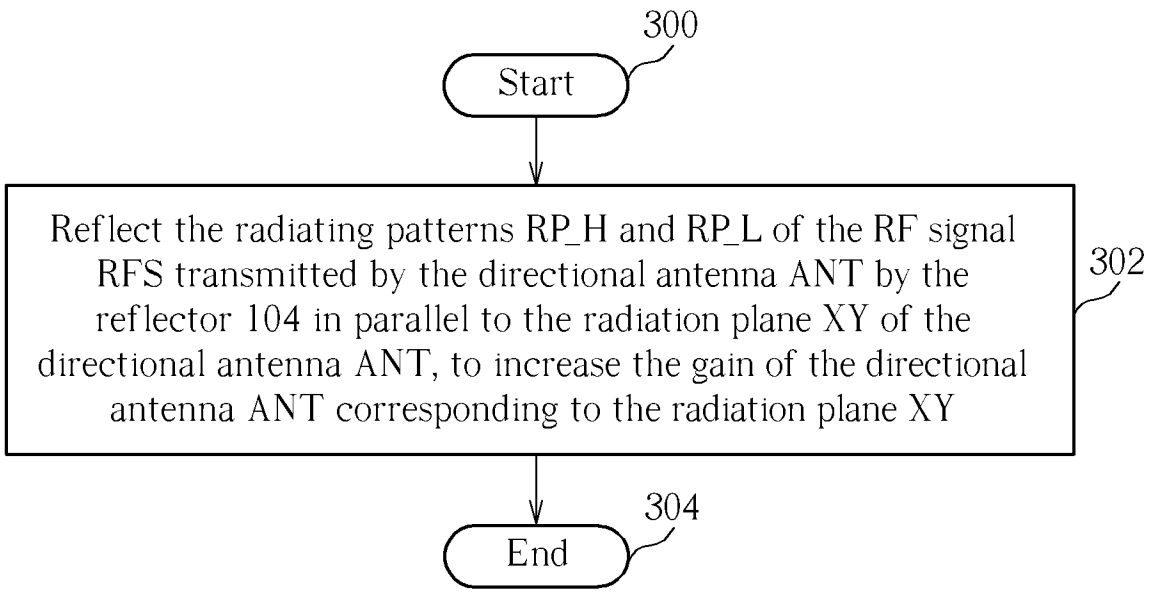
FIG. 3 is a schematic diagram of a radiating pattern adjustment process according to an embodiment of the present invention.

Operations of adjusting the radiating patterns RP_H and RP_L to increase the gain corresponding to the radiation plane XY of the directional antenna ANT can be summarized into a radiating pattern adjustment process 30 as shown in FIG. 3. The radiating pattern adjustment process 30 includes the following steps:

Step 300: Start.

Step 302: Reflect the radiating patterns RP_H and RP_L of the RF signal RFS transmitted from the directional antenna ANT by the reflector 104 in parallel to the radiation plane XY of the directional antenna ANT, to increase the gain of the directional antenna ANT corresponding to the radiation plane XY.

Step 304: End.

Details of the radiating pattern adjustment process 30 can be derived by referring to the above description.

Figure 4:
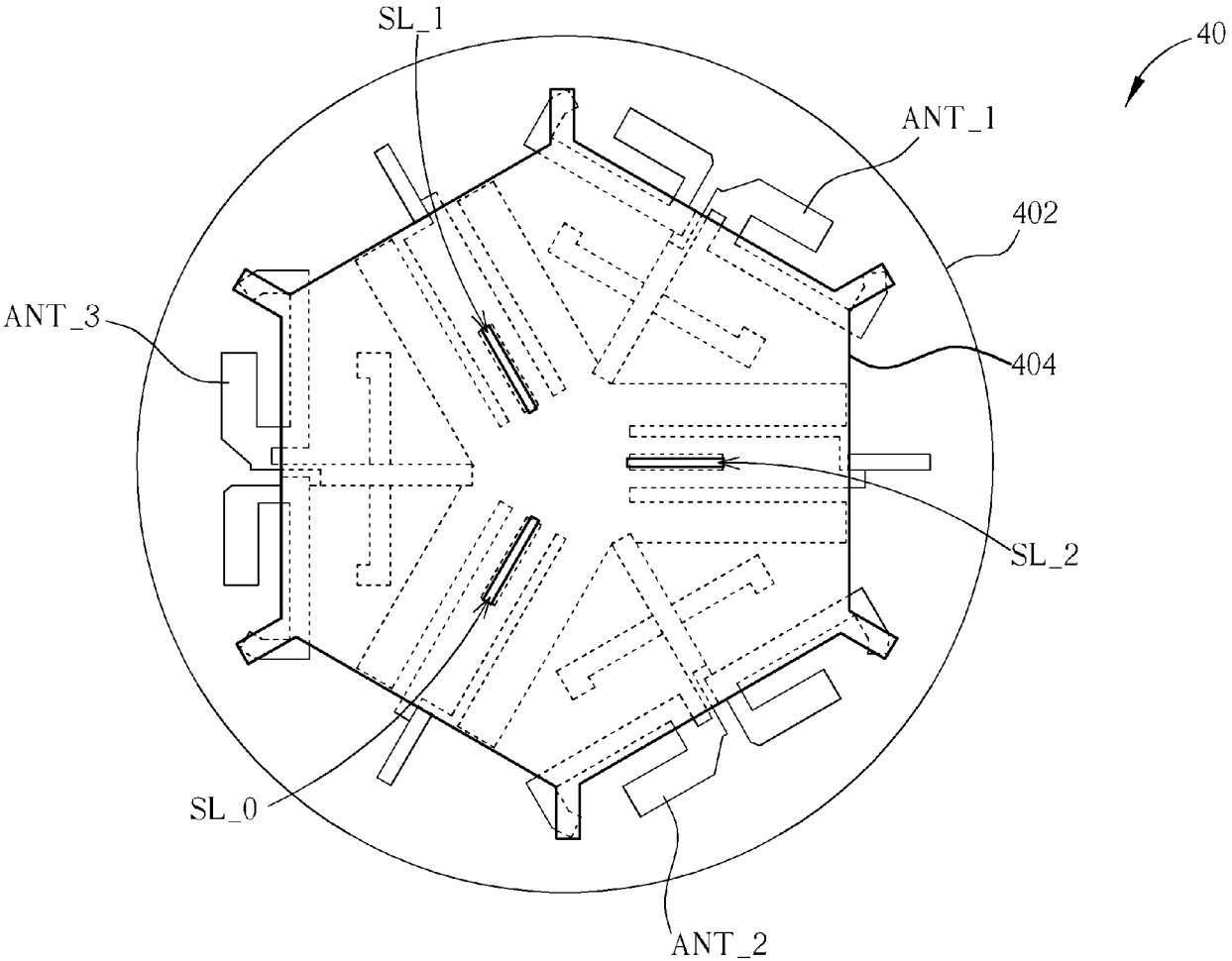
FIG. 4 is a schematic diagram of a transceiver according to an embodiment of the present invention.
Figure 5:
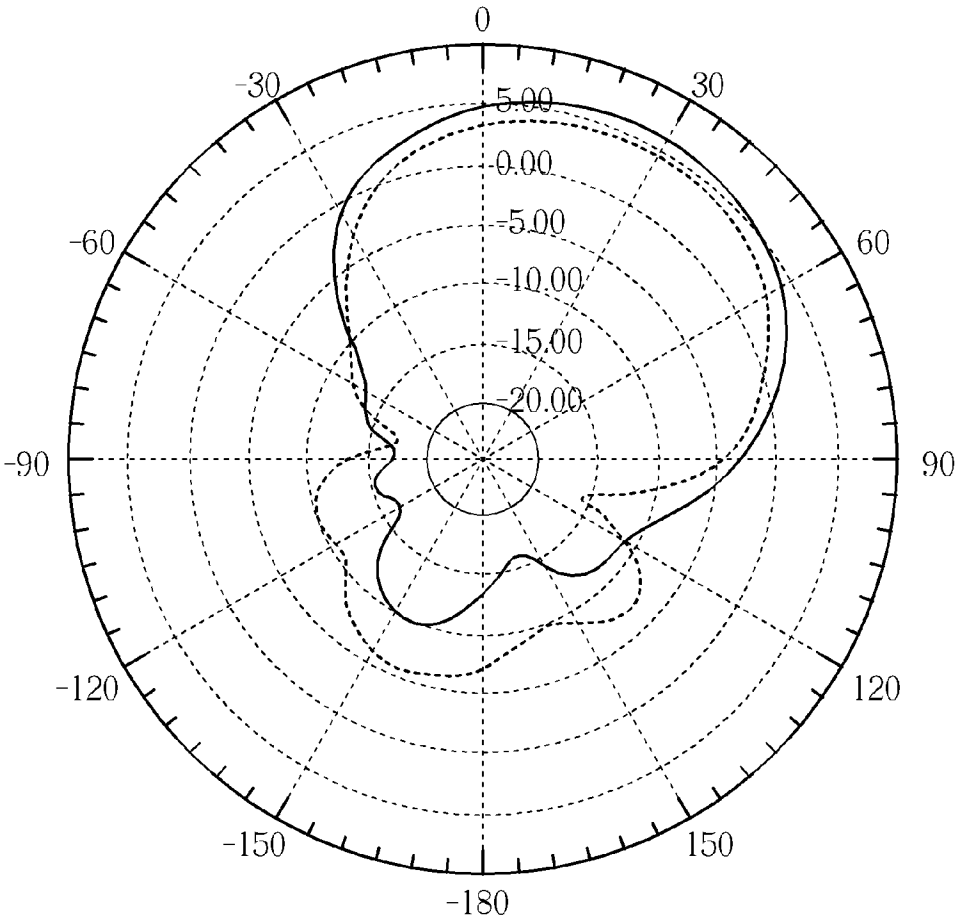
FIG. 5 is an antenna gain pattern diagram of the directional antenna shown in FIG. 4.

Please refer to FIG. 4, which is a schematic diagram of a transceiver 40 according to an embodiment of the preset invention. The transceiver 40 includes a substrate 402, directional antennas ANT_1-ANT_3 and a reflector 404. The directional antennas ANT_1-ANT_3 are identical printed Yagi-Uda antennas with the horizontal polarization direction, and are arranged on the substrate 402 to equally divide a circle into three 120-degree sectors, for transmitting and receiving RF signals from the horizontal radiation plane. To compare antenna performance before and after adding the reflector 404, herein taking the directional antenna ANT_1 as an example. Please refer to FIG. 5, which is a schematic diagram denoting the directional antenna ANT_1 with and without the reflector 404 by a solid line and a dotted line, respectively. As can be seen from FIG. 5, a peak gain of the directional antenna ANT_1 is 4.5 dBi without the reflector 404, while a peak gain of the directional antenna ANT_1 is 6.5 dBi with the reflector 404. Moreover, an antenna directivity of the directional antenna ANT_1 is improved as well. Since the directional antennas ANT_1-ANT_3 are identical, antenna peak gains and directivities of the directional antennas ANT_2 and ANT_3 are also improved via adding the reflector 404. As a result, by adding the single reflector 404, the antenna gains and the directivities of the directional antennas ANT_1-ANT_3 are improved simultaneously.

Figure 6A:
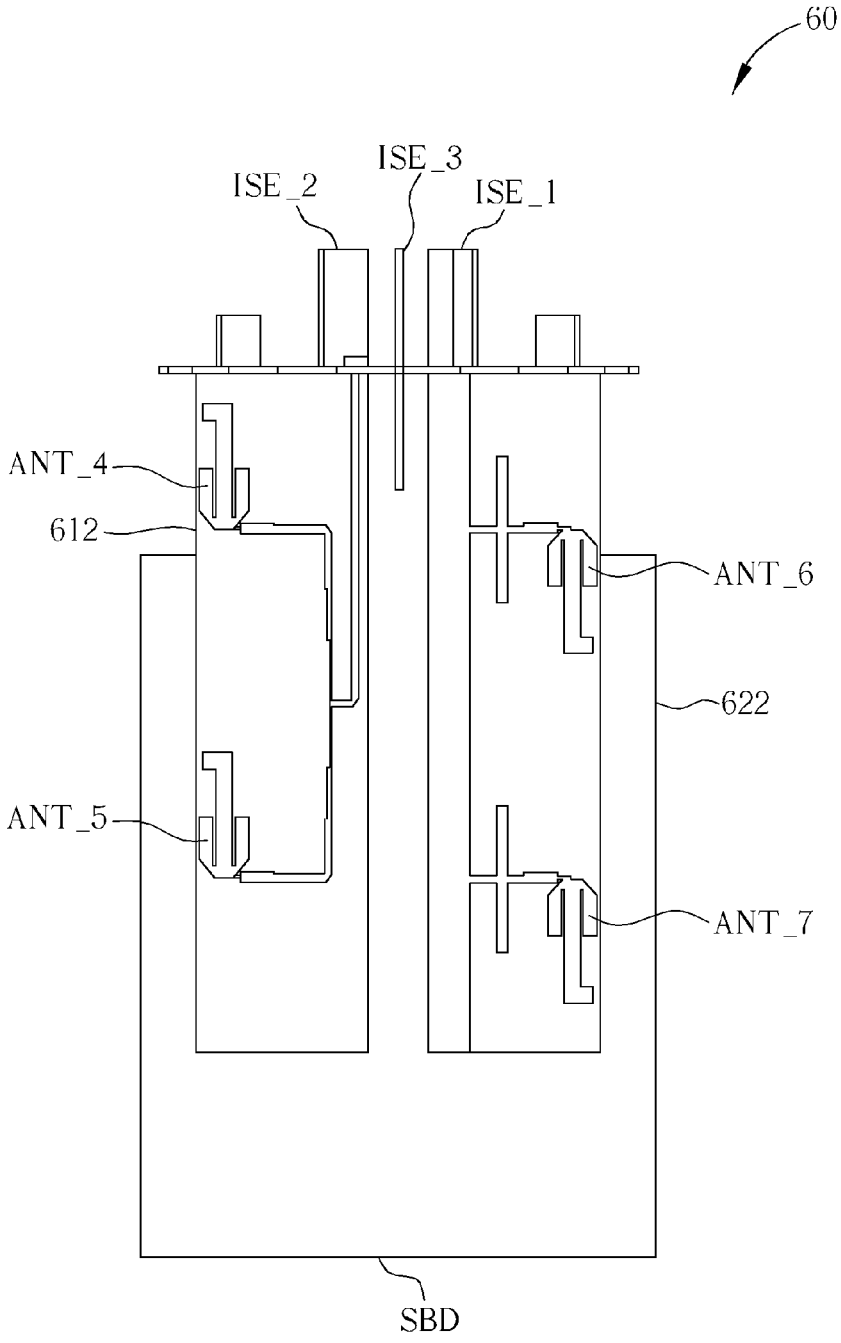
FIG. 6A and FIG. 6B are side-view and isometric diagrams of a transceiver according to an embodiment of the present invention.
Figure 6B:
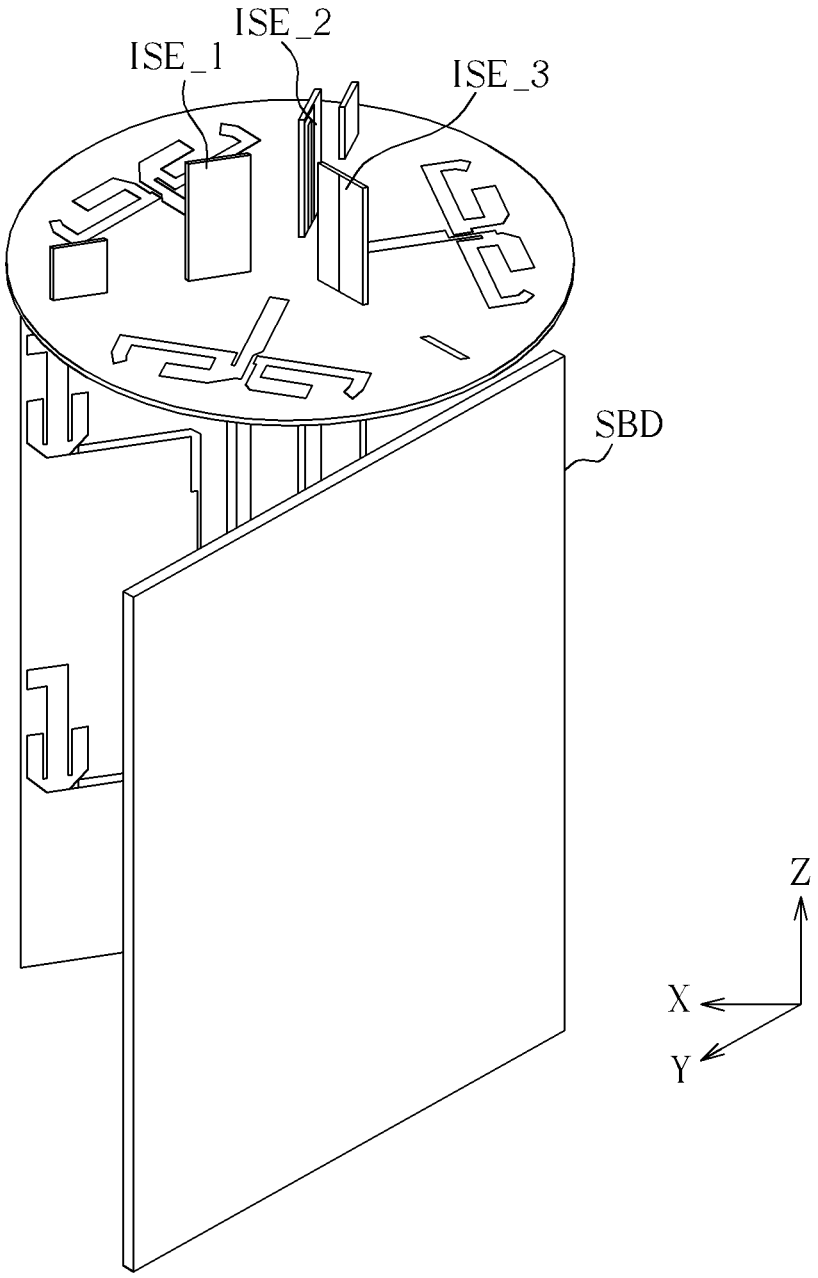

Furthermore, the transceiver 40 may also combine another transceiver for increasing different directional antennas, so as to increase different polarization direction and enhance radiation coverage of the transceiver 40. Please refer to FIG. 6A and FIG. 6B, which are side-view and isometric diagrams of a transceiver 60 according to an embodiment of the present invention, respectively. The transceiver 60 includes the transceiver 40, vertically polarized antennas ANT_4-ANT_7 and a system board SBD. The directional antennas ANT_4-ANT_7 are identical printed Yagi-Uda antennas with the vertical polarization direction. The directional antennas ANT_4 and ANT_5 are formed on the substrate 612, and the directional antennas ANT_6 and ANT_7 are formed on the substrate 622, for transmitting and receiving RF signals from the vertical polarization direction. The substrates 612 and 622 are FR4 double-layered fiber glass boards, and include insertion elements ISE_1 and ISE_2. The transceiver 40 further includes an insertion element ISE_0 and the reflector 404 of the transceiver 40 includes slots SL_0, SL_1 and SL_2 corresponding to the insertion elements ISE_0, ISE_1 and ISE_2, for fixing the reflector 404 and the substrates 402, 612 and 622. Please note that, the method of fixing the reflector 404 is not limited, and the reflector 404 can be fixed by other mechanical parts on a housing of the transceivers 40 and 60 as well.

Figure 7:
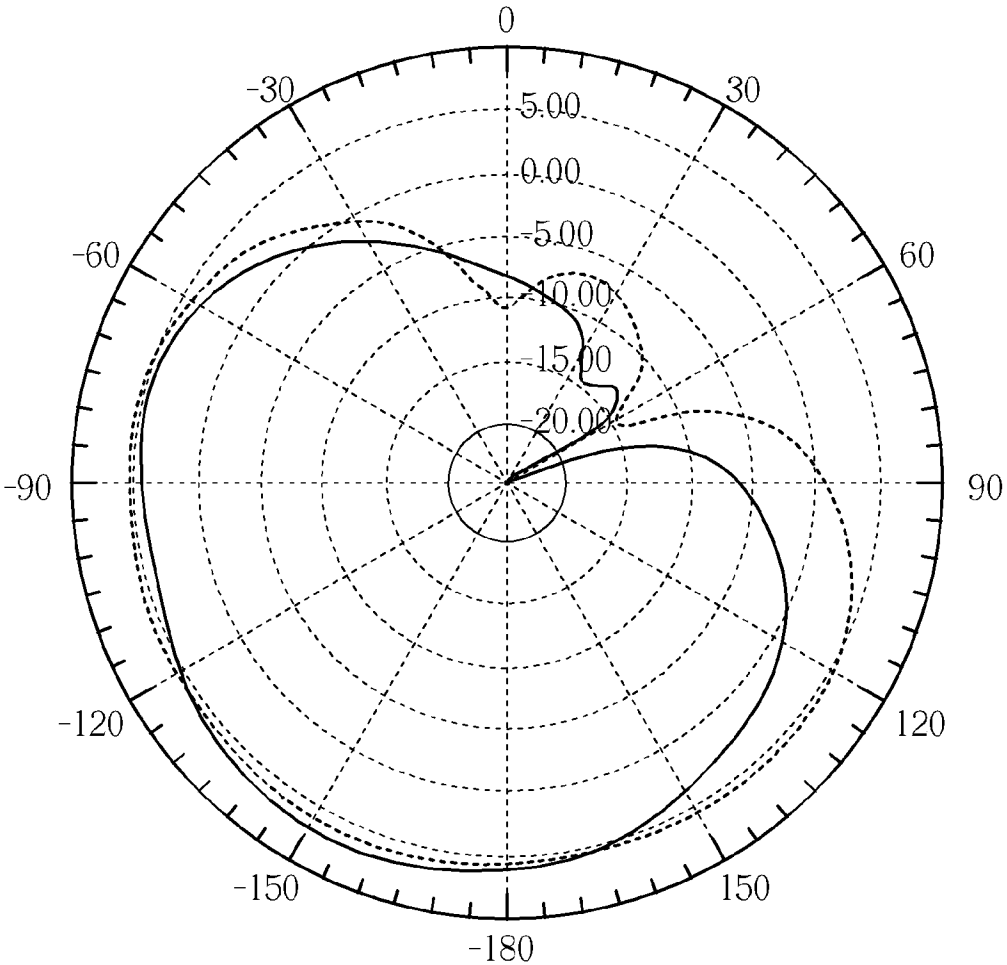
FIG. 7 is an antenna gain pattern diagram of the directional antenna shown in FIG. 6A.

In such an arrangement, the directional antennas ANT_4-ANT_7 form a radiating pattern within the radiation plane XY, and the system board SBD is disposed in parallel to a radiation plane XZ. Please note that, the system board SBD is regarded as a reflector performing reflection. As a result, please refer to FIG. 7, which is a schematic diagram denoting the antenna gain of the directional antenna ANT_4 with and without the system board SBD by a solid line and a dotted line, respectively. As can be seen from FIG. 7, a peak gain of the directional antenna ANT_4 is 5.6 dBi without the system board SBD, while a peak gain of the directional antenna ANT_4 is 7 dBi with the system board SBD. Moreover, an antenna directivity of the directional antenna ANT_4 is improved as well. Since the directional antennas ANT_4-ANT_7 are identical, antenna peak gains and directivities of the directional antennas ANT_5 and ANT_7 are also improved via adding the system board SBD. As a result, by adding the single system board SBD, the antenna gains and the directivities of the directional antennas ANT_4-ANT_7 are improved simultaneously.

Figure 8:
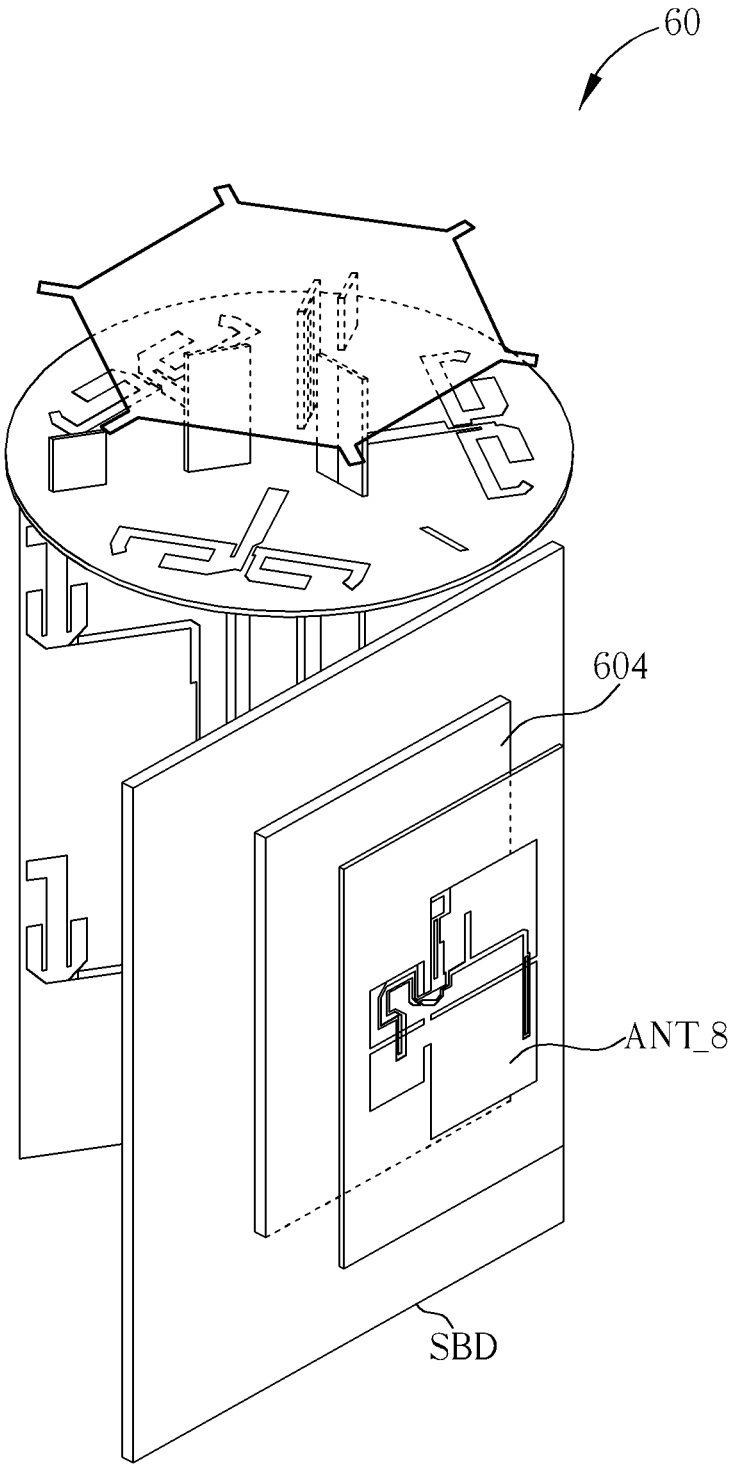
FIG. 8 is a schematic diagram of a transceiver according to an embodiment of the present invention.

The transceiver 60 may further include a directional antenna ANT_8 at the other side of the system SBD as shown in FIG. 8, so as to cover 360 degree radiation plane XY. The directional antenna ANT_8 is a printed dual-band slot antenna, which also has a reflector 604. Similarly, the reflector 604 reflects a radiating pattern of the directional antenna ANT_8, for increasing an antenna gain and a directivity of the directional antenna ANT_8.

To sum up, the present invention adds the reflector insulated from the directional antenna and disposed in parallel to the radiation plane, to reflect the radiating pattern of the directional antenna, which increases antenna gain corresponding to radiated direction of the directional antenna without modifying the directional antenna. In comparison, the traditional method is to add directors to the direction antenna, for directing a current route in the radiator, which changes the radiating body and increase area of the directional antenna. Besides, when there are multiple directional antennas, the traditional method has to add directors on each of the antennas respectively, which significantly increases the total antenna area. However, the present invention adds single reflector in parallel to the radiation plane, such that antenna gains of the multiple directional antennas are increased at one time, which is simpler and easier.

Those skilled in the art will readily observe that numerous modifications and alterations of the device and method may be made while retaining the teachings of the invention.

What is claimed is:

1. A directional antenna for a multi-in multi-out or antenna beam switchable wireless communication system, comprising:

a substrate;

at least one directional antenna, formed on the substrate, for generating a radiating pattern of a radiation plane according to a feeding signal; and a reflector, disposed in parallel to the radiation plane of the directional antenna, for reflecting the radiating pattern of the directional antenna, to increase a gain of the directional antenna corresponding to the radiation plane.

2. The directional antenna of claim 1, wherein the substrate comprises at least one insertion element formed vertically on the substrate, and the reflector comprises at least one slot corresponding to the insertion element, for fixing the reflector and the substrate.

3. The directional antenna of claim 1, wherein the substrate is an FR4 double-layered fiberglass board.

4. The directional antenna of claim 1, wherein a polarization direction of the directional antenna is a horizontal polarization direction or a vertical polarization direction.

5. The directional antenna of claim 1, wherein the reflector is insulated from a ground or the at least one directional antenna.

6. The directional antenna of claim 1, wherein the reflector is a metal sheet or a system board.

7. The directional antenna of claim 1, wherein the directional antenna is a printed dual-band linear polarization antenna.

8. The directional antenna of claim 7, wherein the directional antenna is a printed Yagi-Uda antenna.

9. A radiating pattern adjustment method for a directional antenna, comprising:

reflecting a radiating pattern of a signal transmitted from the directional antenna by a reflector in parallel to a radiation plane of the directional antenna, to improve a gain of the directional antenna corresponding to the radiation plane.

10. The radiating pattern adjustment method of claim 9, wherein the step of reflecting the radiating pattern comprises insulating the reflector from a ground or the directional antenna.

11. The radiating pattern adjustment method of claim 10, wherein the reflector is a metal sheet or a system board.

12. The radiating pattern adjustment method of claim 11, wherein a polarization direction of the directional antenna is a horizontal polarization direction or a vertical polarization direction.

* * * * *